United States Patent [19]

Rojey et al.

[11] Patent Number: 4,771,824

[45] Date of Patent: Sep. 20, 1988

[54] METHOD OF TRANSFERRING HEAT FROM A HOT FLUID A TO A COLD FLUID USING A COMPOSITE FLUID AS HEAT CARRYING AGENT

[75] Inventors: Alexandre Rojey, Garches; Alain Grehier, Paris, both of France

[73] Assignee: Institut Francais du Petrole, Rueil-Malmaison, France

[21] Appl. No.: 837,129

[22] Filed: Mar. 7, 1986

[30] Foreign Application Priority Data

Mar. 8, 1985 [FR] France ..... 85 03410

[51] Int. Cl.[4] ..... F28D 15/02

[52] U.S. Cl. ..... 165/104.13; 165/104.14; 165/104.21; 165/32; 62/114

[58] Field of Search ..... 165/104.13, 104.14, 165/104.21, 32; 62/114

[56] References Cited

U.S. PATENT DOCUMENTS

| | | | |
|---|---|---|---|
| 2,033,228 | 3/1936 | Buffington | 62/114 |
| 2,492,725 | 12/1949 | Ashley | 62/114 |
| 3,171,477 | 3/1965 | Huet | 165/104.21 |
| 4,222,436 | 9/1980 | Pravda | 165/104.13 |
| 4,303,536 | 12/1981 | Orfeo et al. | 62/114 |
| 4,314,601 | 2/1982 | Giuffre et al. | 165/104.21 |

OTHER PUBLICATIONS

Heat Transfer in Counterflow, Parallel Flow and Cross Flow, Helmuth Hausen, McGraw Hill, New York, 1983, pp. 232–233.

*Primary Examiner*—Albert W. Davis, Jr.
*Attorney, Agent, or Firm*—Millen & White

[57] ABSTRACT

A method of transferring heat from a hot fluid to a cold fluid by means of a heat carrying fluid formed from at least two non azeotropic constituents contained in a looped circuit. The hot fluid gives up its heat in an exchanger, this heat being used for evaporating the heat carrying fluid which is then condensed in an exchanger while giving up its condensation heat to the cold fluid. A heat carrying agent reservoir accomodates the heat flux variations and a system imposes a flow direction on the heat carrying fluid.

18 Claims, 5 Drawing Sheets

METHOD OF TRANSFERRING HEAT FROM A HOT FLUID A TO A COLD FLUID USING A COMPOSITE FLUID AS HEAT CARRYING AGENT

BACKGROUND OF THE INVENTION

1. Field of the Invention

The purpose of the method of the invention is to transfer heat from a hot fluid (A) to a cold fluid (B) and more particularly to recover available heat from a hot fluid for transferring it to a cold fluid to be heated.

2. Description of the Prior Art

In numerous cases, such a heat exchange cannot be effected under satisfactory conditions by placing the hot fluid and the cold fluid directly in exchange relation in a heat exchanger. This is particularly the case when these two fluids flow in ducts spaced apart from each other, the fact of bringing them into contact in an exchanger leading to a cumbersome and costly installation or else to unacceptable pressure losses. This may occur more particularly for exchanges between gases flowing at relatively low pressures.

In such a case it is known to use a heat carrying agent such as water, water containing glycol or else liquid organic fluids with a high boiling temperature, flowing in an exchange loop. The heat carrying fluid being heated by the hot fluid in a first heat exchange zone and heating the cold fluid in a second heat exchange zone separate from the first one.

Such a system requires the permanent operation of a circulation pump which involves maintenance for ensuring reliable operation over a long period of time. Furthermore, none of the fluids used is entirely satisfactory. Water used without antifreeze cannot be used in winter in most cases of application; water containing glycol which overcomes this disadvantage has characteristics of high viscosity adversely affecting the heat transfer and leads to corrosion risks. Finally, heavy organic fluids are expensive and also have a high viscosity.

It is further known that heat transfer may be accomplished by vaporization and condensation of a fluid such as water or an organic fluid; however, such a technique is not adapted to the heat exchange between fluids whose temperature varies during the exchange and in particular cannot be used if the temperature ranges for the hot fluid and the cold fluid partially overlap.

A heat transfer system using a heat carrying fluid flowing in a circuit forming a loop has been described by Guiffre et al. in the U.S. Pat. No. 4,314,601.

This system comprises an evaporator, a condenser and a central collector connected together by a loop circuit (FIG. 2 of Guiffre et al.). In this system the fluid leaving the evaporator is mixed in the central collector with the fluid leaving the condenser, which means that the temperature of the fluid leaving the evaporator is lowered whereas the temperature of the fluid leaving the condenser is increased, thus the inlet temperatures of the evaporator and of the condenser are respectively higher and lower than those at the outlet of the condenser and of the evaporator. The increase in the enthalpy of the fluid between its leaving the condenser and its entry into the evaporator results in limited efficiency of cooling of the external fluid; similarly, reduction of the enthalpy of the fluid entering the condenser results in an overall relatively limited efficiency of heating of the external fluid. The overall efficiency of the heat transfer of this system between hot fluid and cold fluid is therefore relatively low. Furthermore, the use of the system, coupled to the use of fluid mixtures, leads to obtaining different concentrations of each fluid in the condenser and in the evaporator which corresponds to different temperature ranges: it will therefore in such a case be difficult to work with partial overlap of the ranges of variation of the temperatures of the hot fluid and of the cold fluid.

The U.S. Pat. No. 4,216,903 describes a heat exchange system comprising an exchange loop using as heat carrying fluid, for example, a halogenated hydrocarbon or a mixture of halogenated hydrocarbons. Heat exchange with an external fluid in the condenser, for heating water, takes place in the aggregate in counter current fashion, whereas the heat exchange at the condenser, for reheating air, takes place in aggregate in cross current fashion and the heat exchange with an external fluid in the evaporator takes place in the aggregate in co-current fashion. The system comprises a liquid reserve of heat carrying fluid situated between the outlet of the condenser and the inlet of the evaporator and at least a U shaped tube whose topmost part is situated at a level between the lowest level of the evaporator and the highest level of the evaporator, which defines the flow direction of the heat carrying fluid.

The use of non azeotropic mixtures, such for example as those described in the patent application EP No. 57,120, in the above described system, means that the system cannot correctly respond to a variation of the input temperature of the external fluids and/or to a variation of the flow rate of these fluids.

SUMMARY OF THE INVENTION

One of the objects of the invention is to describe a method allowing a high heat recovery rate without consumption of mechanical energy and which may be used even at low temperatures without comprising any risk of freezing provided that an appropriate heat carrying fluid has been chosen. In particular, the invention describes a method of transferring heat from a hot fluid to a cold fluid giving the possibility of operating with partial overlap of the ranges of variation of the temperature of the hot fluid and of the cold fluid, so with a better heat recovery rate, as well as operating with relatively high variations either of the input temperatures of the hot and/or cold fluids, or of the flow rates of said fluids.

The method of the invention for transferring heat from a relatively hot fluid (A) to a relatively cold fluid (B) in which a heat carrying fluid is maintained in a continuous duct forming a substantially isobar looped circuit and comprising in series at least two separate heat exchange zones (I) and (II), said heat carrying fluid comprising at least two constituents capable of evaporating and condensing as a non azeotropic mixture, the vaporization of said heat carrying fluid taking place at least partially in a temperature range situated at least partly below the temperature of the fluid (A) and condensation of said heat carrying fluid taking place at least partly in a temperature range situated at least partly above the temperature of the fluid (B), comprises the following steps:

(a) the heat carrying fluid is caused to flow in the liquid phase in aggregate in counter current contact with the relatively hot fluid A in the exchange zone (I) so as to vaporize said heat carrying fluid at least partially, (b) said heat carrying fluid at least partially vaporized obtained in step (a) is fed into a liquid accumulation zone placed in said continuous loop forming duct, at the outlet from the exchange zone (I) on the side where said totally or partially vaporized fluid exits, (c) the vapor phase of said heat carrying fluid leaving step (b) is fed into the exchange zone (II) without subjecting it either to compression or to expansion, (d) the heat carrying fluid in the vapor phase is caused to flow in aggregate in counter current contact with the relatively cold fluid (B) in the exchange zone (II), so as to condense said heat carrying fluid at least partially, (e) the heat carrying fluid in the liquid phase obtained in step (d) is recycled to step (a) without subjecting it to compression or expansion, the arrangement of the exchange zones(I) and (II) being such that the level of the interface of the continuous liquid phase formed by condensation in zone (II) is situated above the level at which vaporization of said continuous liquid phase begins in zone (I).

Under the effect of the heat supplied by the fluid (A) the heat carrying agent evaporates at least partially and leaves the exchange zone (I) in the gaseous state through its hottest end (that which is the closest to the intake point or points of fluid (A)) so as to pass into the accumulation zone and reach the exchange zone (II) at the end closest to the outlet point or points of the fluid (B). In the zone (II), the gaseous heat-carrying fluid progressively condenses entirely or partially, while yielding its condensation heat to the fluid (B). The condensed heat carrying fluid leaves in the liquid state through the end of the zone (II) the closest to the intake point or points of the fluid (B) and falls back by gravity to the zone (I) where it penetrates through the end the closest to the outlet point or points of the fluid (A). Thus the exchanges take place in aggregate in counter current fashion. The circuit is said to be substantially isobar because it comprises neither compression zone nor expansion zone, the small pressure differences observed at different points of the circuit being due mainly to pressure losses in the circuit.

An essential characterisic of the method of the invention resides in the fact that no mechanical device is required, the transfer of the mixture between the exchange zones I and II taking place naturally by itself, under the sole effect of the heat transfers in the exchange zones I and II and of the differences in density between the vapor phase and the liquid phase of the heat carrying fluid. This characteristic allows a sealed circuit to be readily obtained without risk of leaks of the mixture and avoids the problems of maintenance and reliability related to the use of a compressor or a pump.

In other words, the method of the invention for transferring heat from a relatively hot fluid (A) to a relatively cold fluid (B) in which a heat carrying fluid is maintained in a closed circuit comprising in series at least two separate heat exchange zones (I) and (II), said heat carrying fluid comprising at least two constituents capable of evaporating without forming any azeotrope therebetween, comprises the following steps:

(a) the liquid phase mixture is vaporized progressively at least partially with raising of the temperature of the mixture by heat-exchange substantially in counter current contact with a first external fluid introduced at a temperature higher than that at which vaporization of said mixture begins and which transfers heat thereto in the first heat exchange zone I, (b) said heat carrying fluid, at least partially vaporized, obtained in step (a) is fed into a liquid accumulation zone placed in said continuous loop forming duct, at the outlet of the exchange zone (I) on the side where said totally or partially vaporized fluid exits, said accumulation zone allowing the device to better respond to the transferred power variations by a variation of the composition of said heat carrying fluid flowing in said continuous duct, (c) the vapor phase obtained in step (a) and leaving step (b) is fed into the second heat exchange zone II without undergoing either compression or expansion, (d) the vapor phase mixture is condensed progressively with lowering of the temperature of the mixture by a substantially counter current heat exchange with a second external fluid introduced at a temperature less than that at which condensation of said mixture begins and which receives heat in the second exchange zone II, (e) the liquid phase obtained during step (d) is recycled to the first heat exchange zone without undergoing either compression or expansion, steps (b), (c) and (e) being accomplished preferably without appreciable heat exchange with the outside and the mean level of the exchange zone II being higher than the mean level of the exchange zone I.

BRIEF DESCRIPTION OF THE DRAWINGS

The method and the devices for implementing the invention are illustrated in FIGS. 1 to 11.

DESCRIPTION OF THE PREFERRED EMBODIMENTS

Figure 1:
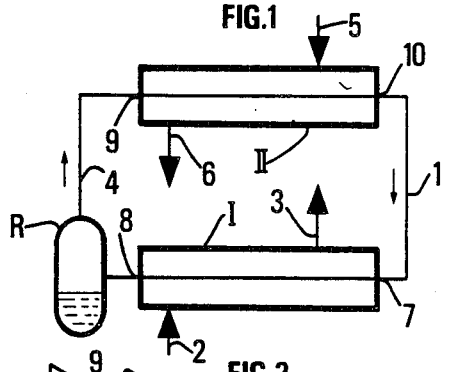
FIG. 1 shows a first embodiment of the invention.

A first embodiment of the method of the invention is shown schematically in FIG. 1. The non azeotropic mixture which flows in the continuous duct forming a looped circuit shown in FIG. 1 arrives in the liquid state through duct 1 at the end 7 of the exchange zone I, called "evaporator" in which it is placed in heat exchange relation by indirect substantially counter current contact with a first external fluid which arrives through duct 2 at a temperature greater than that at which vaporization of said non azeotropic mixture begins and leaves through duct 3; said non azeotropic mixture leaving the exchange zone I through its end 8 passes into a liquid phase reserve (R) placed at the outlet of the evaporator and flows into duct 4 connecting the reserve (R) to the end 9 of exchange zone II.

The vapor phase of a non azeotropic mixture obtained at the end 8 of the exchange zone I passes into the reserve (R) and arrives through duct 4 at the end 9 of the exchange zone II, in which said mixture is placed in heat exchange relation by indirect substantially counter current contact with a second external fluid which arrives through duct 5 at a temperature lower than that at which condensation of said non azeotropic mixture begins and leaves through duct 6; said non azeotropic mixture leaving the exchange zone II by its end 10 through duct 1 connecting the end 10 of the exchange zone II with the end 7 of the exchange zone I.

Figure 2:
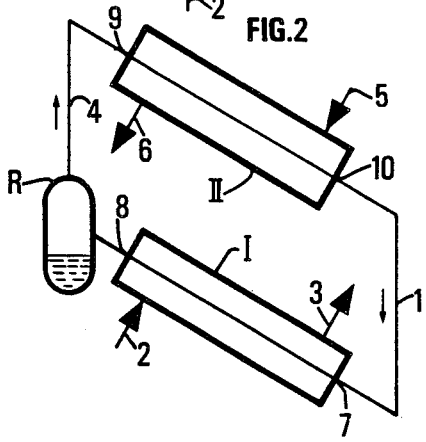
FIG. 2 shows one embodiment of the invention in which the exchange zones I and II are formed by heat exchangers substantially slanted with respect to the horizontal. With this construction start up of the method is easier.

A second embodiment of the method of the invention is shown schematically in FIG. 2. The operation of the process is substantially similar to that described above for FIG. 1. The exchange zones I and II are substantially slanted with respect to the horizontal. The end 7 of exchange zone I into which the non azeotropic mixture penetrates, in the liquid state, is at a level substantially lower than the level of end 8 of said zone through which said non azeotropic at least partially vaporized mixture leaves. In a preferred arrangement, said non azeotropic mixture penetrating into the exchange zone I at the end 7 rises substantially continuously up to the level of end 8; the slope of this exchange zone being possibly substantially constant. The end 9 of the exchange zone II into which the vapor phase of the non azeotropic mixture pentrates is at a level substantially higher than the level of end 10 of said zone through which said non azeotropic at least partially condensed mixture leaves. In a preferred arrangement, the vapor phase of the non azeotropic mixture penetrating into the exchange zone II at end 9 drops substantially continuously to the level of end 10; the slope of this exchange zone may be substantially constant; said slope (tangent of the angle formed by the axis of the exchange zone with the horizontal plane) being advantageously from about 0.01 to about 1.75 and preferably from about 0.1 to 1.

The liquid phase contained in the reserve (R) placed at the outlet of the evaporator is richer in the heaviest constituent and more impoverished in the lighest constituent than the vapor phase which leaves through duct 4 and than the liquid phase which comes back through duct 1. Said reserve (R) being such that there is no appreciable heat exchange with the outside. The temperature of the reserve (R) is the same as the outgoing temperature of the heat carrying fluid arriving at end 8 of the evaporator. The reserve (R) serves a dual purpose in the method of the invention:

1 - It allows the outlet duct of the evaporator to be cleared in the case where the outgoing temperature is not sufficient for the whole of the heat carrying fluid to be completely vaporized. In the case of incomplete vaporization, the reserve thus provides an easier flow of the liquid/gas balanced mixture arriving at the outlet of the evaporator.

2 - It allows a strict adjustment of the temperature range imposed by the external fluid flowing in the evaporator. When the outgoing temperature is insufficient for completely vaporizing the heat carrying fluid, liquid enriched with the heaviest constituent accumulates in the reserve. The liquid then coming back from the condenser, enriched with the lighest constituent, will be completely vaporized. Thus, for example, if the temperature variation of the external fluid (A) flowing through the exchange zone I (evaporator) (temperature difference between the ingoing temperature and the outgoing temperature of the external fluid (A)) decreases, vaporization of the non azeotropic mixture becomes incomplete and the unvaporized part richer in the heaviest constituent accumulates in the reserve (R), the vaporized mixture is enriched with the lightest constituent.

Thus by using the non azeotropic mixture and the reserve, the bubble temperature—dew temperature difference may be adapted to the external conditions while keeping the advantage of a heat exchange by latent heat: any evaporation takes place in the evaporator.

When the conditions of the external fluid (A) change and if the incoming temperature of this latter increases, the temperature of the heat carrying fluid leaving the exchanger and which arrives in the reserve also increases, the vaporized fraction is therefore enriched with heavy fluid, the composition of the heat carrying fluid then coming back from the condensation zone (II) and again reaching the evaporation zone (I) remaining richer in heavy fluid is better adapted to the new incoming and outgoing temperature difference of the fluid (A), which again ensures the heat exchange by latent heat. Contrary to this case, the use of a pure body, when the temperature of the fluid (A) increases again, would not have ensured the new exchange by latent heat, the enthalpic gain in the case of a pure body only being able to take place as sensible heat. A sensible heat exchange has several drawbacks:

fluid-wall exchange coefficient between 10 and 40 times smaller therefore requiring an exchange surface 10 to 40 times greater in order to provide the same exchange power, heat transport by sensible heat requires a much larger mass flow rate because of the ratio of the specific heat of the gas to the latent vaporization heat of the liquid.

For example, in the case of halogenated fluids R11 ($CCl_3F$) and R12 ($CCl_2F_2$) the respective specific heats of the gases are, at 30° C., 565 J/Kg.K for R11 and 607 J/Kg.K for R12 and the latent vaporization heats of the liquids are, at 30° C., 177970 J/Kg for R11 and 135020 J/Kg for R12, that is to say for a heat difference of 10° C. a mass heat transporting capacity between 22 and 31.5 times smaller for sensible heat.

When the flow rate increases in response to an increase of transferred power, the liquid level in duct 1 rises and the liquid level in the reserve (R) drops. The result is an increase in the heavy constituent content of the mixture which is flowing. This variation of composition results in widening of the vaporization and condensation range if the heavy constituent is in the minority and a reduction of the vaporization and condensation range if the heavy constituent is in the majority. If the increase in transferred power is due not to an increase of the flow rates of the external fluids but to an increase of the difference between the incoming temperatures of said external fluids, it is thus possible to very simply adjust the composition of the mixture by using the system shown schematically in FIGS. 1 to 4 in which the mixture used comprises a minority proportion of the heavy constituent.

Figure 3:
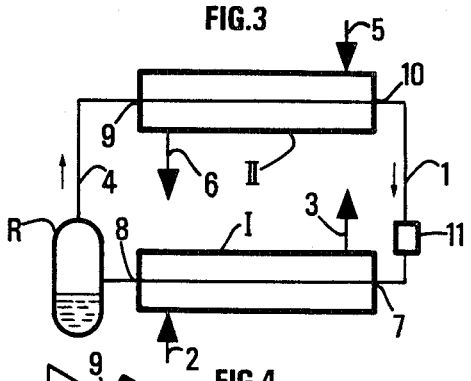
FIGS. 3 and 4 show embodiments closer related to those of FIGS. 1 and 2. These embodiments comprise a system (11) for imposing a flow direction on the heat carrying fluid and possibly for limiting and/regulating the flow of the liquid phase.
Figure 4:
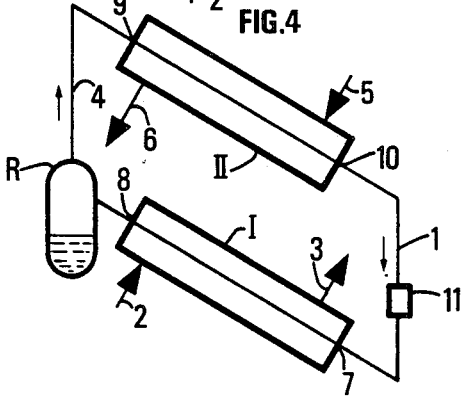

In a particularly advantageous embodiment of the method of the invention, schematized in FIGS. 3 and 4, a system (11) is inserted between the exchange zones 1 and II, preferably between the end 10 of exchange zone II and the end 7 of the exchange zone I in the liquid phase flow duct 1 for preventing the flow in the opposite direction of the non azeotropic mixture. Working of the method shown schematically in FIGS. 3 and 4 is substantially the same as that described above with reference to FIGS. 1 and 2. Except for the system (11), the other elements and arrangements of FIGS. 3 and 4 correspond respectively to the elements and arrangements of FIGS. 1 and 2. The system (11) may for example be a valve formed of a device such as shown schematically in FIG. 5 or in FIG. 6, or for example a capillary type diaphragm creating a pressure drop associated with a liquid reserve creating a liquid buffer preventing the flow in the reverse direction of the non azeotropic mixture. The device shown in FIG. 5 or in FIG. 6 comprises a float 12 resting on a seat 15, said float having a density less than that of the condensate coming from the exchange zone II, said condensate flowing through the duct 1. Said condensate cannot flow below the valve if the liquid level 14 is too low to exert on the float a sufficient Archimedes thrust to cause said float to rise because of the contact of said float on seat 15 which closes duct 1 (this is the case shown in FIG. 5). When the condensate accumulates above seat 15, the level 14 of the liquid rises and reaches a height such that the Archimedes thrust exerted on float 12 is sufficient for causing said float to rise which, no longer resting on its seat 15, lets the condensate flow into duct 1 towards the exchange zone I (this is the case shown in FIG. 6). If the flow rate of the condensate from the exchange zone II is greater than the flow rate in duct 1 towards the exchange zone I, the level 14 of the liquid rises and the float 12 also rises as far as the stop 13 which prevents the float from continuing its rise, but which is disposed so that it allows the level 14 of the liquid to continue rising in duct 1.

If the flow rate of the condensate leaving the exchange zone II is less than the flow rate in duct 1 towards the exchange zone I, the level 14 of the liquid drops and float 12 also drops until it comes to rest on seat 15 thus closing the duct 1 and therefore preventing the liquid buffer existing above the zone of contact of float 12 on seat 15 to flow in duct 1 towards the exchange zone I.

The mass of the float 12 will for example be greater than or equal to a value such that it is sufficient, without a liquid buffer in valve 11, to prevent the non azeotropic mixture from passing from the exchange zone II to the exchange zone I.

The height separating the level corresponding to float 12 seated on its seat 15 from the minimum liquid level 14 corresponding to the beginning of rising of float 12 will be such that the hydrostatic pressure of the condensate column included between these two levels is sufficient to prevent the non azeotropic mixture from passing from exchange zone II to the exchange zone I.

The choice of the mass and of the other characteristics of float 12 depends in particular on the choice of the non azeotropic mixture and more particularly on its density.

Figure 5:
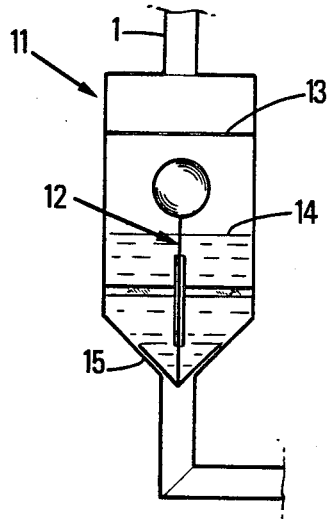
FIGS. 5 and 6 show one of the systems (11) which may be used for imposing the flow direction of the heat carrying fluid and possibly for limiting and/or regulating the flow of the liquid phase.
Figure 6:
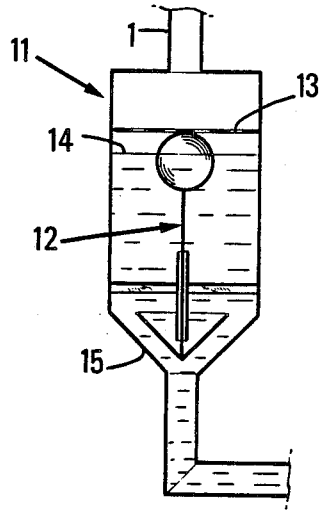

The use of a system (11) such as the one shown in FIGS. 5 and 6 is particularly well adapted to the case where the transfer of heat between the relatively hot fluid (A) and the relatively cold fluid (B) comprises one or more transitory operating conditions, said system (11) further providing, in this case, a certain regulation of the flow of the heat carrying fluid.

It is necessary for the system (11) to be situated at a level such that, before the method is set in operation, the hydrostatic pressure of the liquid column at rest and/or the mass of the float is sufficient, at start up, to prevent the non azeotropic mixture from passing from the exchange zone (I) to the exchange zone (II) through duct 1 (see FIGS. 3 or 4) that is to say sufficient to impose the flow direction of the heat carrying fluid.

During operation of the above described devices, the non azeotropic mixture arrives in the liquid state through duct 1 and enters the exchange zone I through its end 7.

The mixture is progressively vaporized, at least partially, as it progresses between the ends 7 and 8 of the exchange zone I with a rise of temperature which corresponds at least partially to the vaporization range of said mixture. Thus, the temperature of the mixture may evolve according to a temperature profile parallel to the evolution of the temperature of the external fluid which is cooled between inlet 2 and outlet 3 of the exchange zone I. To obtain such exchange conditions, it is desirable to select the mixture so that the vaporization range is as close as possible to the range of variation of the temperature of the external fluid and it is important for the exchange to be effected under conditions as close as possible to the counter current exchange. The mixture forming the heat carrying fluid will be advantageously chosen so that the ratio delta T/delta T' of the vaporization range (delta T) of the heat carrying fluid to the temperature variation range (delta T') of the relatively hot fluid (A) flowing in the exchange zone (I) is 0.6:1 to 1.5:1 and preferably 0.8:1 to 1.2:1. When the heat exchange takes place with air or with a gas, the exchange battery will be preferably designed so as to allow a combined counter current/crossed current exchange mode.

The non azeotropic mixture vapor phase obtained at end 8 of the exchange zone I tends to move from bottom to top, because of its relatively low density; it passes through the reserve (R) and flows through duct 4 to reach the end 9 of the exchange zone II in which the non azeotropic mixture is progressively condensed, at least partially, as it progresses between the ends 9 and 10 of the exchange zone II, with a temperature drop which corresponds at least partially to the condensation range of said mixture.

The whole of the circuit is substantially isobar, the pressure variations being only related to the pressure losses due to the flow of the mixture and induced by the reserve (R) and/or induced by the presence of the system (11). Under these conditions the condensation range is the same as the vaporization range and during the condensation step the mixture follows in the opposite direction (temperature drop instead of temperature rise) an evolution substantially identical to the temperature evolution followed during the vaporization step. During said condensation step, the mixture cools whereas the external fluid is heated. It is also advantageous to carry out this exchange under conditions as close as possible to a counter current exchange.

The liquid phase obtained flows down naturally, because of its relatively high density, through duct 1 to the exchange zone I without undergoing either compression or expansion.

The non azeotropic mixture used must comprise at least two constituents not forming an azeotrope with each other, characterized by boiling temperatures differing by at least 15° C. (at the working pressure) and preferably at least 30° C. Each of said constituents being present in a proportion of at least 5% (for example 5 to 95% and 95 to 5% in the case of two constituents) in moles and preferably at least 10% in moles.

The mixtures used may be mixtures of two, three (or more) constituents (separate chemical compounds). At least one of the constituents of the mixture may be a hydrocarbon whose molecule comprises for example from 3 to 8 carbon atoms, such as propane, normal butane, isobutane, normal pentane, isopentane, neopentane, normal hexane, isohexane, normal heptane, isoheptane, normal octane, and isooctane as well as an aromatic hydrocarbon such as benzene and toluene or a cyclic hydrocarbon such as cyclopentane and cyclohexane.

The mixture used may contain a halogenated fluid of the "freon" type (CFC) or be formed by a mixture of halogenated fluids of the "freon" type (CFC); among these fluids may be mentioned trifluoromethane $CHF_3$ (R23), chlorotrifluoromethane $CClF_3$ (R13), trifluorobromomethane $CF_3Br$ (R13B1), chlorodifluoromethane $CHClF_2$ (R22), chloropentafluoroethane $CClF_2$—$CF_3$ (R115), dichlorodifluoromethane $CCl_2F_2$ (R12), difluoroethane $CH_3CHF_2$ (R152*a*), chlorodifluoroethane $CH_3$—$CClF_2$ (R142*b*), dichlorotetrafluoroethane $CClF_2$-$CCLF_2$ (R114), dichlorofluoromethane $CHCl_2F$ (R21), trichlorofluoromethane $CCl_3F$ (R11), trichlorotrifluoroethane $CCl_2FCClF_2$ (R113), dichlorohexafluoropropane (R216).

At least one of the constituents of the mixture may be an azeotrope of chlorofluorocarbonated compounds, a substance which has the property of behaving like a pure fluid; among the main azeotropes which may be used, the following may be mentioned:

R500: azeotrope of R12/R152*a* (73.8%/26.2% by weight)

R501: azeotrope of R22/R12(75%/25% by weight)

R502: azeotrope of R22/R115 (48.8%/51.2% by weight)

R503: azeotrope of R23/R13 (40.1%/59.9% by weight)

R504: azeotrope of R32/R115 (48.2%/51.8% by weight)

R505: azeotrope of R12/R31 (78.0%/22.0% by weight)

R506: azeotrope of R31/R114 (55.1%/44.9% by weight)

Other types of mixtures are mixtures comprising water and at least a second constituent miscible with water such as the mixtures formed of water and ammonia, the mixtures formed of water and an amine such as methylamine or ethylamine and the mixtures of water and of ketone such as acetone.

It is generally advantageous to choose non azeotropic mixtures of a particular composition so that the vaporization/condensation range is adjusted as a function of the temperature ranges of the external fluids. The advantages resulting from the choice of such compositions are only effective if said non azeotropic mixture is associated with the use of substantially counter current exchange modes.

In the process of the invention described in FIGS. 1 to 4, the exchange zone I through which the hot fluid passes is below the exchange zone II through which the cold fluid passes. Thus, the condensed liquid phase at the exit from exchange zone II flows by gravity to the exchange zone I. An important criterion in selecting the non azeotropic mixture will be the density of the liquid phase in duct 1.

The exchange zones I and II are generally formed by conventional exchangers in which the heat exchanges are effected in substantially counter current fashion.

In some applications and in particular when the heat exchange is effected with air it is difficult to obtain pure counter current exchange mode; in these cases, the use of exchange batteries such as those shown in FIGS. 8 to 11 permitting a composite cross current/counter current exchange is particularly advantageous. The heat exchange devices, for putting the method of the present invention into practice, in particular those which concern a heat exchange between two gas currents, one relatively hot in the exchange zone (I) and the other relatively cold in the exchange zone (II) comprise in each of the zones at least one exchanger element providing a substantially counter current heat exchange, the exchanger element (s) being advantageously formed by at least one hollow element or tube, advantageously comprising fins; the non azeotropic mixture forming the working fluid being at least partially vaporized in said exchange zone (I) formed by at least said hollow element or tube and preferably formed by an assembly of hollow elements or tubes, and said working fluid being condensed in said exchange zone (II) formed by at least said hollow element or tube, the liquid phase obtained during said condensation step in said exchange zone (II) returning by gravity through at least one duct or junction connecting said exchange zones (I) and (II) together to said exchange zone (I), vapor formed in said zone (I) after passing through the reserve (R) returning through at least a second duct or junction, said second duct or junction being separate from said first duct or junction.

Different devices for implementing the invention are described below with reference to FIGS. 8 to 11.

For the sake of simplicity of the diagrams, the reserve (R) has not been shown in these Figures.

In the example of a device for implementing the method of the invention shown in FIG. 8, the exchange zone I corresponding to the evaporator is situated below the exchange zone II corresponding to the condenser, the flow of the non azeotropic mixture takes place generally from bottom to top in zone I and from top to bottom in zone II, whereas the flow of the hot gas with which the mixture is placed in heat exchange relation in zone I takes place from top to bottom and the flow of the cold gas with which the mixture is placed in heat exchange relation in zone II takes place from bottom to top so that the mixture and the gas flow substantially in counter current fashion in the two exchange zones. The device shown in FIG. 8 comprises an assembly of exchanger elements formed preferably by finned tubes of approximately equal length, disposed under one another so that for each assembly of tubes corresponding to each of their zones their longitudinal axes are approximately parallel, situated approximately in the same vertical plane and so that these exchanger elements 20, 21 and 22 of zone I on the one hand and 23, 24 and 25 of zone II on the other are connected hydraulically "in series" by approximately vertical junctions or ducts such as junctions 26 and 27 for the exchanger elements of zone I and junctions 28 and 29 for the exchanger elements of zone II. The end left free of the exchanger element situated at the lowest level in zone I is connected to the end left free of the exchanger element situated at the lowest level in zone II by a junction element or duct 31 and the end left free of the exchanger element situated at the highest level in zone I is connected to the end left free of the exchanger element situated at the highest level in zone II by a junction element or duct 30.

Figure 8:
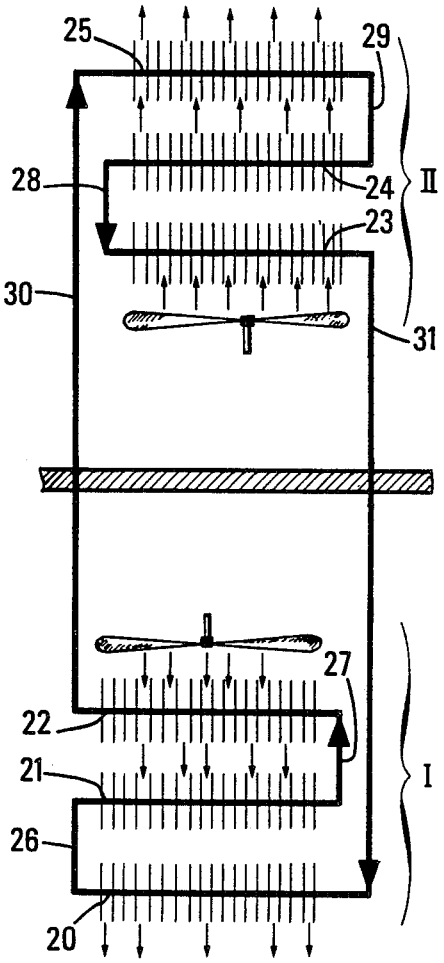
FIGS. 8 to 11 illustrate the devices for implementing the method of the invention.

During operation, the difference of densities of the non azeotropic mixture contained in junctions 30 and 31 establishing communication between the exchange zones I and II induces a thermosiphon effect which causes the mixture to flow in the exchange devices in the directions shown by the arrows in FIG. 8.

Figure 9:
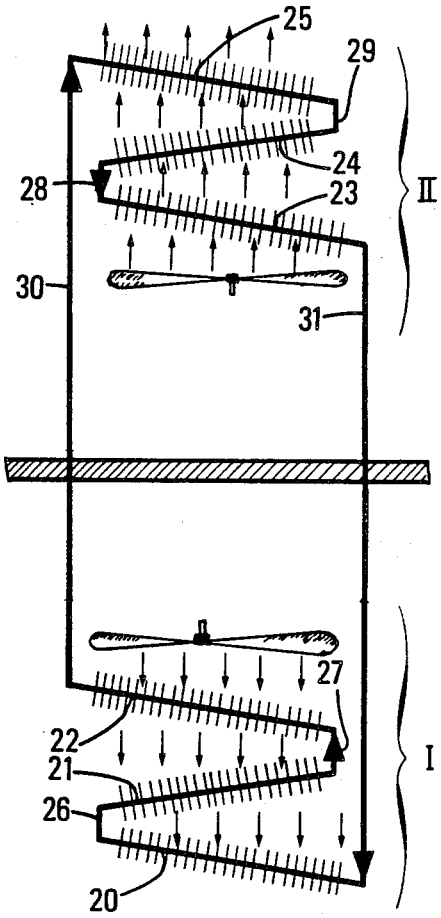

A man skilled in the art will be able to make different modifications to this device for obtaining optimum operation thereof in connection with the particular conditions of the transfer it is desired to obtain; in particular, the number of exchanger elements and preferably of finned tubes may vary within wide limits. A device similar to that of FIG. 8 is shown in FIG. 9. The reference numbers mentioned in FIG. 9 designate the same elements as in FIG. 8. In the preferred device of FIG. 9 comprising finned tubes, said tubes have their longitudinal axes tilted with respect to each other and tilted with respect to the horizontal so that the end left free of the finned tubes situated at the generally lowest level of zone I is at a level lower than that of the other end of said tube and the end left free of the tube situated generally at the lowest level in zone II is at a level lower than that of the other end of said tube. The ends left free of these two tubes 20 and 23 are connected together by the junction tube 31.

The end left free of the tube situated at the generally highest level in zone I is at a level higher than that of the other end of said tube and the end left free of the tube situated generally at the highest level of zone II is at a level higher than that of the other end of said tube. The ends left free of these two tubes 22 and 25 are connected together by the junction tube 30.

Figure 10:
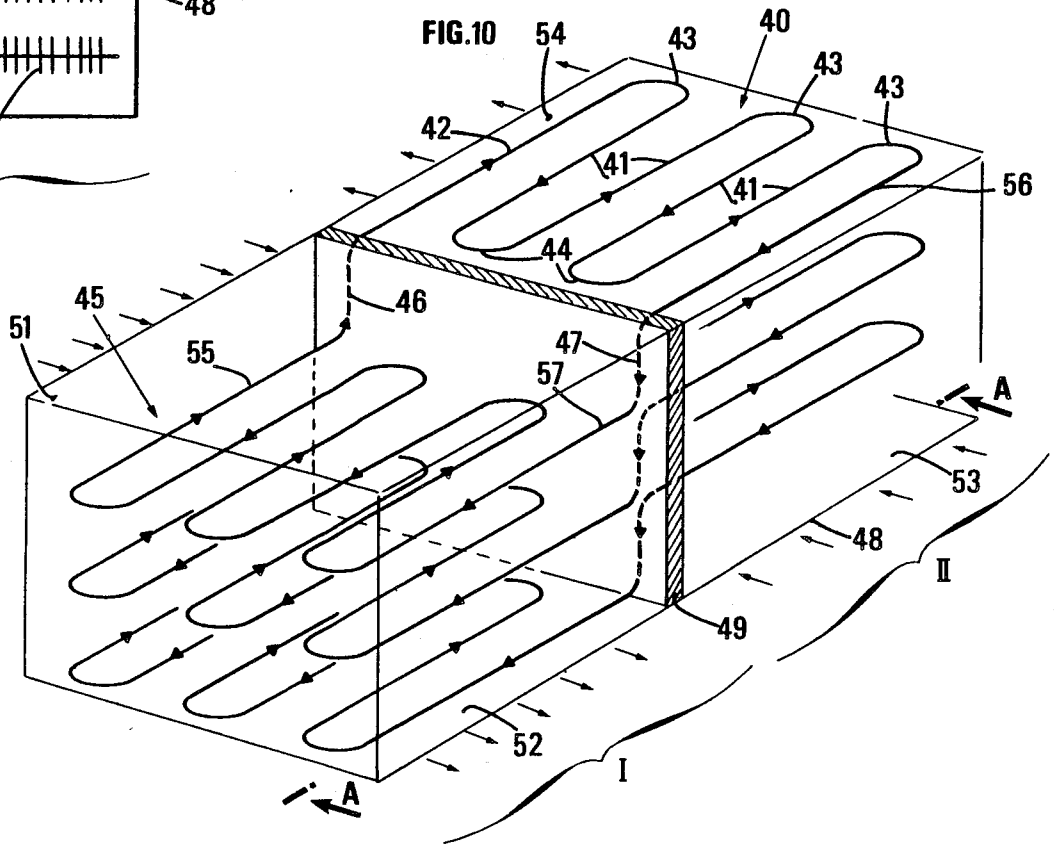
Figure 11:
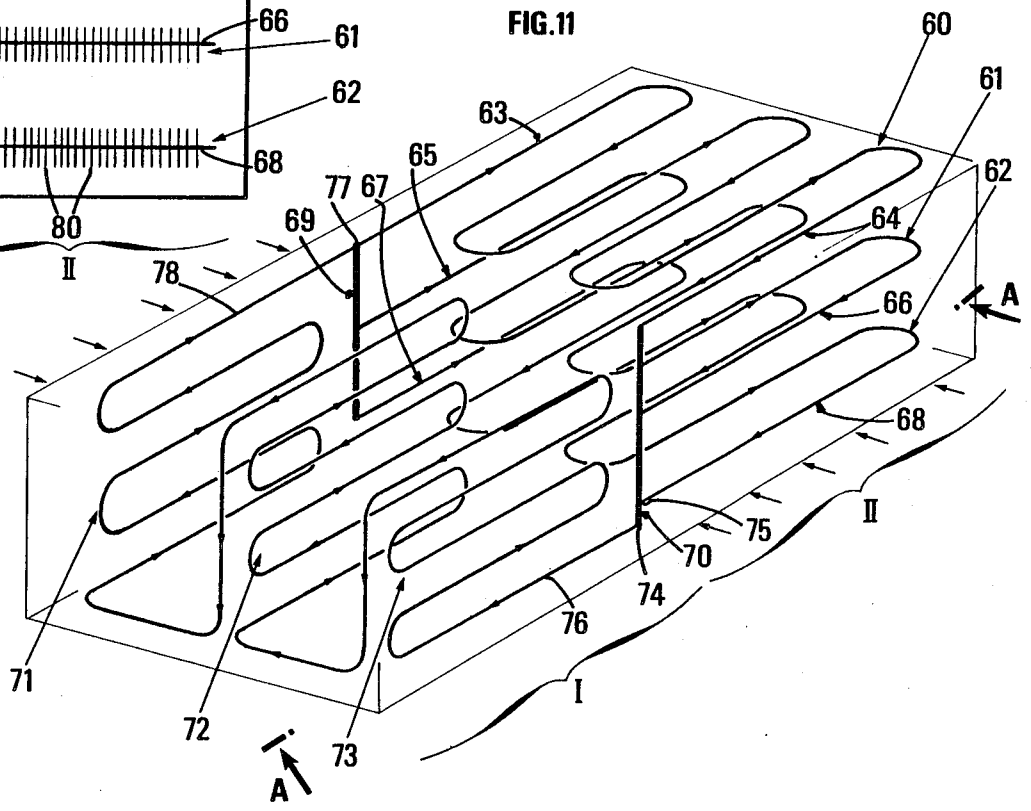

Another example of the device for implementing the method of the invention is shown in FIGS. 10 and 11. The exchangers are batteries formed of stacks which correspond with each other as in the case of FIG. 10 stack by stack with an offset in the vertical direction between the set of stacks forming the battery corresponding to exchange zone I and to that corresponding to exchange zone II; each of said stacks may, such as stack 40 shown in FIG. 10, be for example formed of a single bent tube, as shown schematically in FIG. 10, so that the linear sections 41 of said tube disposed between bends 43 and 44 and the endmost linear sections 42 and 56 are approximately parallel, said linear sections 42 and 56 being connected to sections 41 by bends 43, said linear sections being approximately of the same length and their longitudinal axes being situated approximately in the same horizontal plane. The approximately horizontal planes corresponding to each of the stacks disposed in each of zones I and II are preferably substantially equidistant and each stack of zone I is connected to a corresponding stack in zone II situated in a substantially horizontal plane situated at a level generally higher than the level of the substantially horizontal plane of said stack of zone I. The connection between the tube forming a stack of zone I and the tube forming the corresponding stack of zone II is provided by causing the linear sections situated at the ends of each of the two corresponding stacks to communicate with each other, the longitudinal axes of said linear sections placed at the ends of each of the two corresponding stacks being preferably situated two by two in the same vertical planes; such communication may for example be provided continuously by the same tube or duct forming said stacks. In the arrangement shown schematically in FIG. 10, the stack 40 of zone II is in communication with stack 45 of zone I through tube portions 46 and 47, the whole of the stacks being contained in a casing 48, the stacks of zone I being separated from the stacks of zone II by a wall 49 through which the tube parts pass (such as 46 and 47 connecting stacks 40 and 45 together) which place the pairs of corresponding stacks in communication.

Figure 10A:
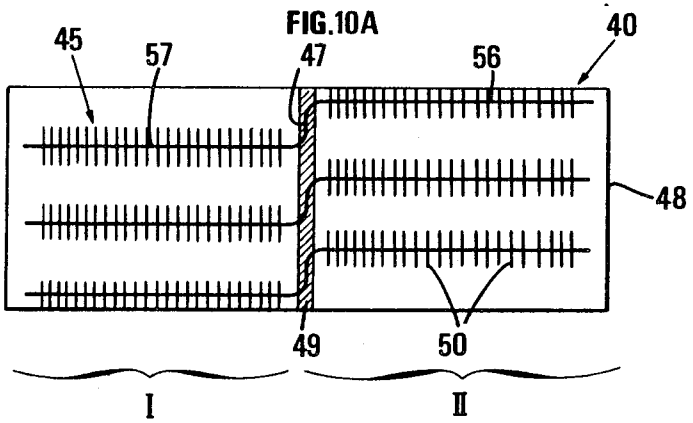

When it is desired to provide heat transfer between two gases, for example between the air extracted from a building and the fresh air which is introduced therein, the tubes preferably forming the stacks such as those shown schematically in FIG. 10 are preferably provided with external fins 50, as shown schematically in the section through A—A (FIG. 10*a*), so as to develop the exchange surface between the gases and the walls of each of the exchanger elements. The walls of casing 48 are advantageously disposed so that the spaces left free about the stacks are reduced as much as possible, the vertical walls, parallel to the linear sections of the tubes forming the stacks, comprising openings for the horizontal passage of the hot gas into zone I and of the cold gas into zone II; the progress of said gases through zones I and II following substantially the same path but in opposite directions.

The temperature differences between the incoming faces 51 of the hot gas and the outgoing faces 52 of this same gas in zone I on the one hand and the incoming faces 53 for the cold gas and the outgoing faces 54 for this same gas in zone II on the other hand induce a difference of density of the non azeotropic mixture at the level of portions 46 and 47 of the connecting tubes of stacks 40 and 45 in zones II and I which causes the mixture to flow by thermosiphon effect in the direction shown by the arrows in FIG. 10.

A particularly advantageous and preferred arrangement in accordance with the invention of the stacks in zones I and II consists in slanting the stacks so that the linear portions 42 and 55 of the hottest tube of a stack, that is to say situated in the vicinity of the hot air intake and of the cold air outlet, are situated respectively at levels higher than the linear portions 56 and 57 of the coldest tube of the corresponding stacks 40 and 45 situated in the vicinity of the outlet for the hot air and the inlet for the cold air.

Another method of arranging the exchange batteries forming the evaporator and the condenser is shown schematically in FIG. 11. The condenser disposed in the exchange zone II comprises the substantially horizontal stacks 60, 61 and 62 similar or identical to those described with reference to FIG. 10, whose endmost linear portions 63, 65 and 67 situated in the vicinity of the cold air outlet communicate with a vertical manifold 69 which may for example be a tube of a sufficiently large diameter with respect to the diameter of the tubes of the exchanger, and the endmost linear portions 64, 66 and 68 situated in the vicinity of the cold air inlet communicate with a vertical manifold 70 which may also for example be a tube identical to the one forming a manifold 69. In the case where manifolds 69 and 70 are tubes, the diameter of these tubes is advantageously greater than or equal to twice and preferably at least three times the diameter of the tubes used for constructing the exchangers.

Figure 11A:
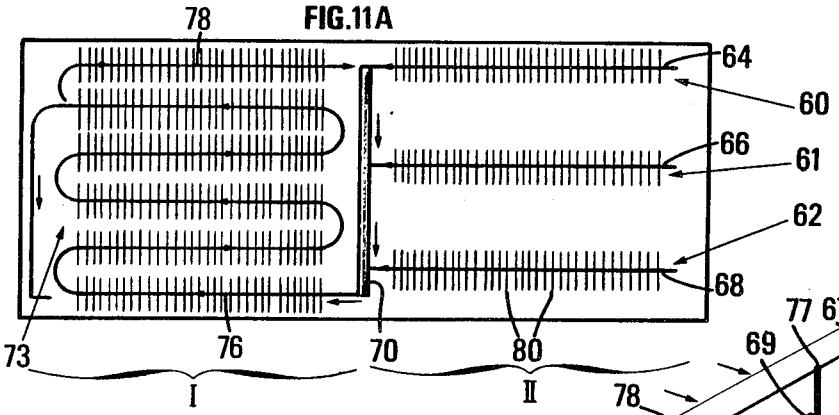

The evaporator situated in the exchange zone I comprises stacks 71, 72 and 73 having the same configuration as the stacks described with reference to FIG. 10 but in which the longitudinal axes of the tubes forming them are placed in substantially vertical planes. The three stacks 71, 72 and 73 are connected hydraulically together "in series", the highest linear portion of stack 73 situated in the vicinity of the relatively hot air outlet being in communication with the lowest linear portion of stack 72, said stack 72 being in communication by its highest linear portion with the lowest linear portion of stack 71 situated in the vicinity of the hot air inlet. The endmost stacks 71 and 73 of zone I are connected respectively to manifolds 69 and 70, the highest linear portion 78 of stack 71 communicating with the highest end 77 of manifold 69 and the lowest linear portion of stack 73 communicating with the lowest end 74 of manifold 70, said lowest end 74 being at a level sufficiently below the main horizontal plane of the lowest stack 62 of zone II so that the upper level of the liquid formed by the condensates coming from the stacks of zone II preferably does not reach during operation, the level of junction 75 of stack 62 with the manifold 70 and the lowest linear portion 76 of stack 73 of zone I being situated at a level lower than the mean level of the plane of stack 62 and lower than the level of junction 75. In operation, the difference between the densities of the non azeotropic mixture contained in manifolds 69 and 70, respectively at least partially in vapor and liquid forms induces a thermosiphon effect which causes the mixture in the exchange device to flow in the direction shown by the arrows in FIG. 11. FIG. 11*a* shows a section through the axis A—A of the device shown in FIG. 11 in the case where the tubes of the stacks of zone II are provided with external fins 80.

In the devices for implementing the method of the invention, such as those shown in FIGS. 8 to 11, the elements used for constructing the exchangers are advantageously tubes having an inner diameter from 4 to 50 mm and preferably from 6 to 30 mm, the distance between the approximately parallel planes of the stacks is preferably between 20 and 300 mm and the fins (50, 80) may have any form, they may for example be round, square or rectangular, the distance between the planes of two successive fins is advantageously from 1.8 to 25 mm. The fins may also be helical, the pitch of the uniform or variable helix being preferably from 1.8 to 25 mm. The elements used for constructing the exchangers may also be hollow elements with square, rectangular or any other section allowing the circulation of the working fluid and an efficient heat exchange with the external fluids. Plate exchangers may also be used. The material or materials used for forming the exchangers are generally copper, steel, aluminium or metal alloys; but the use of plastic materials may also be contemplated. A man skilled in the art will be able to provide all the means required for the correct operation of the installations and not shown in the figures, such for example as drainage and emptying means, as well as making different modifications to the above described devices so as to obtain an optimum operation thereof under the particular conditions of the transfers envisaged.

The above described devices also comprise means for causing the hot fluid A to flow and means for causing the cold fluid B to flow such for example as fans, when the two fluids are gases, in particular air.

Two examples given below describe two particular cases of application of the technique proposed by the invention.

EXAMPLE 1

Let us consider a water/water exchange example corresponding to FIG. 1; the fluid (A) is formed by water which flows through exchange zone I; it arrives through duct 2 at an initial temperature of 40° C. and is discharged through duct 3 at a final temperature of 25° C. (conditions 1).

The heat carrying fluid is a binary mixture formed of 80% in moles of dichlorodifluoromethane R12 and 20% in moles of trichlorofluoromethane R11. The fluid contained initially in the reserve (R) is a binary mixture formed of R12 and R11 in respective concentrations of 52% and 48% in moles.

The mixture is vaporized in transfer zone I by counter current exchange with the fluid (A); it enters the exchanger, at the bottom of pipe 1, at a temperature of 20° C. at a pressure of 4.82 bars; it is completely vaporized, leaves the exchange zone (I) at a temperature of 35° and at a pressure of 4.72 bars and passes into the reserve then into pipe 4. The pressure losses and the thermal leaks of the vapor phase along pipe 4 are disregarded; the mixture, suggested in the example, is then condensed between 35° C. and 20° C., bubble temperature, corresponding to a pressure of 4.82 bars. The condensation of the mixture is caused by counter current exchange with the cold fluid (B), formed by water; this water enters through tube 5 and leaves the exchanger II through tube 6; it is assumed to be heated from 10° C. to 25° C.; the hydrostatic height required is 0.90 m, taking into account the density of the condensed liquid and the pressure losses of the fluid in the circuit. It should be noted that the non azeotropic mixture chosen for this example may allow partial overlapping between the temperature profiles of the fluids (A) and (B).

During operation, fluid (A) evolves and its incoming temperature through duct 2 is established at 35° C., its outgoing temperature through duct 3 at 23.2° C. (conditions 2).

With these new conditions the composition of the gas mixture at the outlet of the reserve (in duct 4) is, expressed in moles, 84.5% of R12 and 15.5% of R11, the composition of the mixture in the reserve is 47% of R12 and 53% of R11 expressed as moles. The mixture enters the exchange zone I at 18.2° C. and at a pressure of 4.55 bars and leaves completely vaporized at a temperature of 30° C. and at a pressure of 4.50 bars. The mixture is then condensed between 30° C. and 18.2° C., the bubble temperature corresponding to a pressure of 4.55 bars. The condensation of the mixture is provided by counter current exchange with the cold fluid (B), formed by water, which is assumed heated from 13.2° C. to 25° C.; the hydrostatic height required in this case is 0.45 m.

Thus, when passing from conditions (1) to conditions (2) the evaporator outlet temperature is no longer sufficient for vaporizing all the mixture in circulation: the unvaporized part, richer in the heavy constituent (R11), then flows into the reserve whose heavy component concentration (R11) increases from 48% to 53% in moles. On the other hand, the vaporized mixture is enriched with light components (R12) which passes expressed as a molar percentage from 80% to 84.5%. The mixture and the reserve have then allowed adaptation of the temperature difference (bubble temperature - dew temperature) of the heat carrying fluid to the external variations. We have then gone from 20°-35° C. for fluid (A) evolving from 40° to 25° C. to 18.2°-30° C. for fluid (A) evolving from 35° to 23.2° C. while keeping the advantage of a heat exchange obtained by latent heat: the whole of the vaporization takes place in the evaporator.

EXAMPLE 2

Air conditioning of data processing premises

Figure 7:
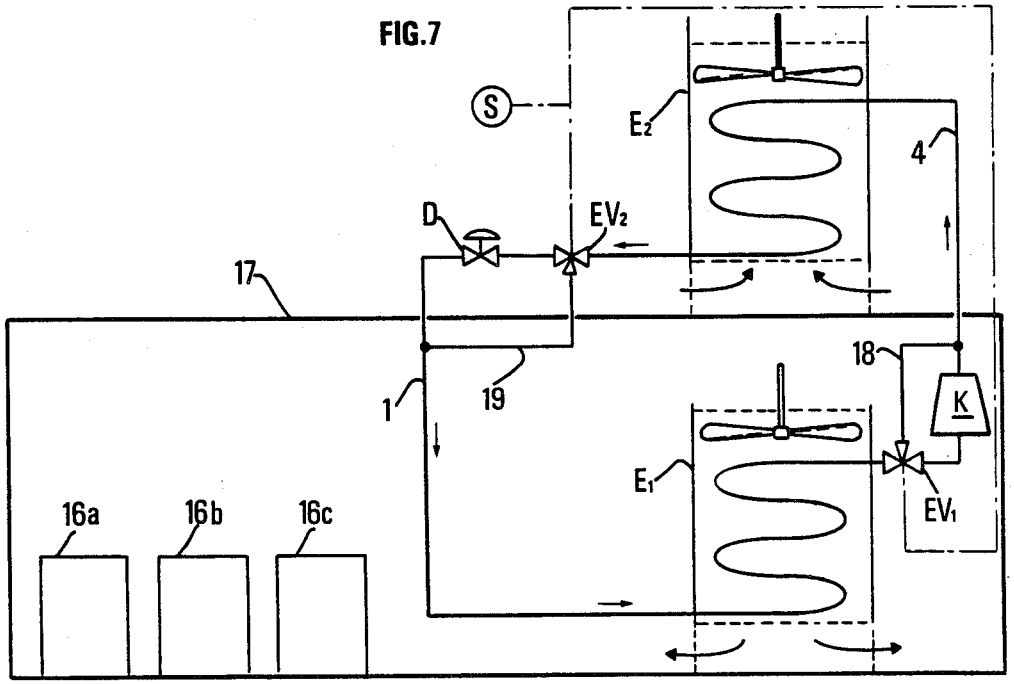
FIG. 7 illustrates the application of the method of the invention to the air conditioning of premises, for example data processing premises, for the sake of simplicity of the drawing, the reserve R has not been shown in this Figure.

Data processing centers require a controlled temperature of approximately 18° C.; generally, a cold air/air or water/air machine is used by taking the heat from the premises to be air conditioned, the condenser discharging the heat outside; the cold loop shown in FIG. 7 then comprises the evaporator ($E_1$), the compressor (K), condenser ($E_2$) and the pressure reducer (D). The evaporator $E_1$ is placed in the computing center 17 which comprises the computing units 16*a*, 16*b*, and 16*c*.

Often in between seasons, indeed most of the time, the outside temperature is lower than that of the premises to be air conditioned; under these conditions, the method described by the invention may be advantageously applied, by avoiding operation of the compressor. FIG. 7 shows an external temperature probe (S) which controls, as a function of this temperature, the closure of two electromagnetic valves ($EV_1$) and ($EV_2$) placed respectively at the outlet of the evaporator ($E_1$) and at the outlet of the condenser ($E_2$); when the outside temperature falls below a chosen value, the electromagnetic valves ($EV_1$) and ($EV_2$) controlled by the temperature probe (S) close, thus bypassing the compressor (K) and the pressure reducer (D) through the ducts 18 and 19 respectively.

The air of the premises to be air conditioned is permanently cooled from 18° C. to 8° C. with a flow rate of 200 $m^3/h$; the power taken from the evaporator ($E_1$) is 720W and compensates the heat losses caused by the operation of the computers or data processors. In between seasons the outside air will be heated, for example, from 5° C. to 15° C.; a non azeotropic fluid mixture will be selected so as to have a total evaporation and condensation range of the order of 10° C.; under the conditions of the example, this evaporation will take place between 6.5° C. and 16.5° C.

The conditions may evolve, for example, in the following way through a judicious choice of the fluid mixture and the reserve disposed downstream of the evaporator (outlet of the evaporator): the air of the premises to be air conditioned is permanently cooled from 18° C. to 6° C. with a flow rate of 200 $m^3/h$; the power taken from the evaporator ($E_1$) passes to 864W. The outside air will then be heated for example from 8° C. to 20° C.; the mixture will then evaporate between 7° and 19° C.

The admissible pressure drop in the exchangers ($E_1$) and ($E_2$), compensated for by the hydrostatic liquid height will depend on the density of the fluid at the outlet of the condenser ($E_2$) and on the height between the lower and upper parts of the installation.

If the density of the mixture of chlorofluorocarbonated compounds is of the order of 1.3 and assuming a pressure drop equal to 0.40 bar in the circuit, a liquid height (HL) of 3.20 m will be necessary. The mixture used is a binary or ternary of CFC chosen from the usual fluids given hereafter, for example: R23, R13, R31, R32, R115, R502, R22, R501, R12, R152*a*, R13BI, R500, R142*b*, R133*a*, R114, R11, R216 or R113; more generally, the mixture will comprise at least two chlorofluorocarbonated derivatives of methane or ethane in which the molar concentration of each component will be at least equal to 5%.

Generally, halogenated hydrocarbons have the advantage of having a density greater than that of water; in the method of the invention, it is recommended to select a non azeotropic mixture whose liquid density is greater than 1, preferably greater than 1.2, so as to limit the space required by the installation. In the method used in the invention, the heat exchanges take place in a substantially counter current exchange mode; however, when the heat exchange is effected with air, it is difficult to set up a counter current exchange mode; in this case, the use of exchange batteries allowing a combined cross current/counter current exchange will be preferable. The operating pressure of the system will be preferably greater than the atmospheric pressure, so as to avoid the intake of air into the circuit. It will be less than 3 MPa (megapascals) and preferably will be between 0.1 and 1.5 absolute MPa (1 to 15 absolute bars).

In examples 1 and 2, the principle of the invention was illustrated in FIGS. 1 and 7 in which the gravity flow of the liquid phase from the condensation zone to the evaporation zone is obtained by placing the condenser entirely above the evaporator.

Other arrangements may be envisaged while respecting the principle of the invention and in some cases the two exchangers may be situated at the same level. For the liquid phase flow from zone II to zone I to be possible, the only requirement is that the interface of the continuous liquid phase formed by condensation in zone II be situated at a higher level than the level at which vaporization begins in zone I; in some cases this liquid interface level may be situated inside the condenser, the liquid phase leaving the condenser under cooled, which allows a gravity flow of the liquid phase from the condenser to the evaporator whereas the evaporator and the condenser are situated at the same level.

What is claimed is:

1. A method of transferring heat from a relatively hot fluid to a relatively cold fluid in which a heat carrying fluid is maintained in a continuous duct forming a substantially isobaric, looped circuit and comprising in series at least two separate heat exchange zones, each of said zones having an inlet and an outlet for said heat carrying fluid, said heat carrying fluid comprising at least two constituents capable of evaporating and condensing into a non azeotropic mixture, vaporization of said heat carrying fluid taking place at least partially in a temperature range situated at least partially below the temperature of the relatively hot fluid and condensation of said heat carrying fluid taking place at least partially in a temperature of the relatively cold fluid, which method comprises the following steps:

(a) the heat carrying fluid is caused to flow, in liquid phase, substantially countercurrently to the relatively hot fluid in a first heat exchange zone so as to vaporize said heat carrying fluid at least partially, (b) resultant heat carrying fluid at least partially vaporized from step (a) is fed into a liquid accumulation zone, said liquid accumulation zone being posiitoned in said continuous loop forming duct between an outlet of said first heat exchange zone and an inlet of a second heat exchange zone, said liquid accumulation zone containing heat carrying liquid, and said heat carrying liquid having a concentration of said constituents different than the heat carrying fluid entering said zone so as to accommodate heat flux variation, (c) resultant vapor phase of said heat carrying fluid leaving step (b) is fed into said second heat exchange zone without being subjected to compression or expansion, (d) said resultant vapor phase of said heat carrying fluid is caused to flow substantially countercurrently to the relatively cold fluid, in said second exchange zone so as to condense said heat carrying fluid at least partially, (e) resultant heat carrying fluid at least partially condensed from step (d) is recycled to step (a) without being subjected to compression or expansion, said first and seocnd exchange zones being arranged such that the mean level of said second heat exchange zone is situated above the mean level of said first heat exchange zone, and (f) in response to a heat flux variation, transferring at least one component between said heat carrying liquid in the accumulation zone and the heat carrying fluid entering said zone in order to change the concentration of the constituents in the heat carrying fluid.

2. The method as claimed in claim 1, wherein said first and second heat exchange zones are each formed by at least one heat exchanger element substantially tilted with respect to the horizontal at a slope of about 0.01 to 1.75, heat carrying fluid from step (d) enters said first heat exchange zone at a point situated at a level lower than the level of the point at which said heat carrying fluid, at least partially vaporized, leaves said first heat exchange zone and said resultant vapor phase of said heat carrying fluid enters said second heat exchange zone at a point situated at a level higher than the level of the point at which said heat carrying fluid, at least partially condensed, leaves said second heat exchange zone.

3. The method as claimed in claim 2, wherein said heat carrying fluid ascends substantially continuously in said first heat exchange zone and descends substantially continuously in said second heat exchange zone.

4. The method according to claim 2, wherein said slope is about 0.1 to 1.

5. The method as claimed in claim 2, wherein said slope of said at least one heat exchanger element is constant.

6. The method as claimed in claim 1, wherein a system for creating a liquid heat carrying fluid buffer is placed in the continuous loop forming duct between an outlet of said second heat exchange zone and an inlet of said first heat exchange zone, said system being situated at a level such that at start up the hydrostatic pressure of the liquid buffer is sufficient for imposing the flow direction of said heat carrying fluid.

7. The method as claimed in claim 1, wherein said at least two constituents of said heat carrying fluid have boiling points differing by at least 15° C. at the working pressure, the molar proportion of each of said at least two constituents being at least 5%.

8. The method as claimed in claim 7, wherein the consituent of the heat carrying fluid with the highest boiling point is in a minority proportion in said fluid.

9. A method according to claim 7, wherein the molar proportion of each of said at least two constitutents is at least 10%.

10. The method as claimed in claim 1, wherein the ratio of the vaporization range of said heat carrying fluid to the temperature variation range of the relatively hot fluid flowing in said first heat exchange zone is from 0.6:1 to 1.5:1.

11. The method as claimed in claim 10, wherein said ratio is from 0.8:1 to 1.2:1.

12. The method as claimed in claim 1, wherein said method is performed without consumption of mechanical energy.

13. The method as claimed in claim 1, wherein heat exchange in said first and second heat exchange zone is conducted in a composite cross-current countercurrent manner.

14. The method of claim 1, wherein said method is performed in a single continuous loop.

15. The method as claimed in claim 1, wherein said heat carrying liquid comprises said at least two constitutents of said heat carrying fluid.

16. A method according to claim 1 wherein one of said at least two constituents is a hydrocarbon compound having 3–8 carbon atoms.

17. A method according to claim 1, wherein one of said at least two constituents is an azeotrope of chlorofluorocarbonated compounds.

18. A method of transferring heat from a relatively hot fluid to a relatively cold fluid in which a heat carrying fluid is maintained in a continuous duct forming a substantially isobaric, looped circuit and comprising in series at least two seaprate heat exchange zones, each of said zones having an inlet and an outlet for said heat carrying fluid, said heat carrying fluid comprising at least two constituents capable of evaporating and condensing into a non-azeotropic mixture, vaporization of said heat carrying fluid taking place at least partially in a temperature range situated at least partially below the temperature of the relatively hot fluid and condensation of said heat carrying fluid taking place at least partially in a temperature of the relatively cold fluid, which method comprises the following steps:

(a) passing the heat carrying fluid, in liquid phase, substantially countercurrently to the relatively hot fluid in a first heat exchange zone so as to vaporize said heat carrying fluid at least partially, (b) passing resultant heat carrying fluid at least partially vaporized from step (a) into a liquid accumulation zone, said liquid accumulation zone being positioned in said continuous loop forming duct between an outlet of said first heat exchange zone and an inlet of a second heat exchange zone, said liquid accumulation zone containing heat carrying liquid, said heat carrying liquid comprising said at least two constituents of said heat carrying fluid and said heat carrying liquid having a concentration of said constituents different than the heat carrying fluid entering said zone so as to accommodate heat flux variation, (c) passing resultant vapor phase of said heat carrying fluid leaving step (b) into said second heat exchange zone without being subjected to compression or expansion, (d) passing said resultant vapor phase of said heat carrying fluid substantially countercurrently to the relatively cold fluid in said second exchange zone so as to condense said heat carrying fluid at least partially, (e) recycling resultant heat carrying fluid at least partially condensed form step (d) to step (a) without being subjected to compression or expansion, said first and second exchange zones being arranged such that the resultant level of the continuous liquid phase formed by condensation in said second heat exchange zone is situated above the level at which vaporization begins in said first heat exchange zone, and (f) in response to a heat flux variation, transferring at least one component between said heat carrying liquid in the accumulation zone and the heat carrying fluid entering said zone in order to change the concentration of the constituents in the heat carrying fluid.

* * * * *